US007625045B2

(12) United States Patent
Hatcher et al.

(10) Patent No.: US 7,625,045 B2
(45) **Date of Patent: *Dec. 1, 2009**

(54) CHAIR RIDE MECHANISM WITH TENSION ASSEMBLY

(75) Inventors: Stephen D. Hatcher, Jasper, IN (US); Michael L. Deimen, Holland, IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/840,566

(22) Filed: Aug. 17, 2007

(65) Prior Publication Data

US 2008/0030059 A1 Feb. 7, 2008

Related U.S. Application Data

(63) Continuation of application No. 10/915,882, filed on Aug. 11, 2004, now Pat. No. 7,273,253.

(60) Provisional application No. 60/578,233, filed on Jun. 9, 2004.

(51) Int. Cl.
*A47C 1/024* (2006.01)
*A47C 1/00* (2006.01)

(52) U.S. Cl. ..... 297/300.2; 297/342

(58) Field of Classification Search ..... 297/300.4, 297/300.2, 303.2, 342
See application file for complete search history.

(56) References Cited

U.S. PATENT DOCUMENTS

| | | | |
|---|---|---|---|
| 2,471,024 | A | 5/1949 | Cramer |
| 2,859,799 | A | 11/1958 | Moore |
| 3,989,297 | A | 11/1976 | Kerstholt |
| 4,429,917 | A | 2/1984 | Diffrient |
| 4,861,106 | A | 8/1989 | Sondergeld |
| 4,877,291 | A | 10/1989 | Taylor |
| 4,984,846 | A | 1/1991 | Ekornes |
| 5,005,905 | A | 4/1991 | Sondergedl |
| 5,046,780 | A | 9/1991 | Decker et al. |
| 5,251,958 | A | 10/1993 | Roericht et al. |
| 5,308,145 | A | 5/1994 | Koepke et al. |
| 5,577,807 | A | 11/1996 | Hodge et al. |
| 5,725,276 | A | 3/1998 | Ginat |
| 5,765,804 | A | 6/1998 | Stumpf et al. |

(Continued)

*Primary Examiner*—Milton Nelson, Jr.
(74) *Attorney, Agent, or Firm*—Baker & Daniels LLP

(57) ABSTRACT

A task chair, including a backrest assembly and a seat assembly pivotally coupled both to one another and to side portions of a fixed yoke member for synchronized movement, in which the seat of the seat assembly moves upwardly and forwardly concurrently with recline of the backrest of the backrest assembly. The chair further includes a tension assembly including an elongate tension member, such as a leaf spring, secured at one end thereof to the yoke member, and a contact member, such as a contact roller, adjustably mounted to the seat assembly. The contact member engages the tension member such that the tension member resists recline of the backrest assembly and concurrent movement of the seat assembly from their initial positions, and also provides a restoring force which tends to move the backrest to its initial upright position and the seat to its initial rearward and lowered position. The contact member is adjustable with respect to the tension member in order to vary the effective moment arm acting upon the tension member, thereby varying the pre-load of the tension member and the resistance provided by the tension member.

12 Claims, 7 Drawing Sheets

U.S. PATENT DOCUMENTS

| | | | | |
|---|---|---|---|---|
| 5,909,923 | A | 6/1999 | DeKraker | |
| 6,109,694 | A | 8/2000 | Kurtz | |
| 6,250,715 | B1 | 6/2001 | Caruso et al. | |
| 6,412,869 | B1 | 7/2002 | Pearce | |
| 6,439,661 | B1 | 8/2002 | Brauning | |
| 6,523,898 | B1 | 2/2003 | Ball et al. | |
| 6,923,503 | B2 | 8/2005 | Sangiorgio | |
| 6,969,116 | B2 | 11/2005 | Machael et al. | |
| 7,234,775 | B2 * | 6/2007 | Serber | 297/301.1 |
| 2002/0190553 | A1 | 12/2002 | Koepke et al. | |
| 2003/0127896 | A1 | 7/2003 | Deimen et al. | |
| 2003/0137171 | A1 | 7/2003 | Deimen et al. | |
| 2003/0178882 | A1 | 9/2003 | Schmitz et al. | |
| 2005/0275265 | A1 | 12/2005 | Deimen et al. | |

* cited by examiner

CHAIR RIDE MECHANISM WITH TENSION ASSEMBLY

CROSS REFERENCE TO RELATED APPLICATIONS

This application is a continuation of U.S. patent application Ser. No. 10/915,882 filed Aug. 11, 2004, which issued as U.S. Pat. No. 7,273,253 on Sep. 25, 2007, which claims the benefit under 35 U.S.C. §119(e) of U.S. Provisional Patent Application Ser. No. 60/578,233, entitled CHAIR RIDE MECHANISM WITH TENSION ASSEMBLY, filed on Jun. 9, 2004.

BACKGROUND OF THE INVENTION

1. Field of the Invention

The present invention relates to task chairs, and in particular, to a ride mechanism for a task chair, the ride mechanism including an adjustable tension assembly.

2. Description of the Related Art

Task chairs are commonly used by persons while working in a seated position in an office or other occupational environment. Typically, such chairs include a base assembly with caster wheels for rolling movement over a floor surface, a pneumatic cylinder connecting the base assembly to the seat assembly for vertical adjustment, as well as a number of manual adjustment features to allow the user to adjust the movement characteristics of the chair to a desired configuration.

Some known task chairs include a backrest and a seat which are coupled to one another for synchronized movement such that, upon recline of the backrest responsive to reclining movement of a seated user, the seat moves forwardly and a rear portion of the seat moves downwardly. A disadvantage of this arrangement is that, upon reclining movement of the seated user, the user is moved slightly downwardly and away from a desk or other work surface near which the user is seated, and the user's line of sight is also shifted downwardly, requiring the user to adjust their head position to maintain a line of sight to a computer monitor, for example.

Known task chairs additionally include tension assemblies for providing a restoring force to the backrest of the chair, which force tends to bias the backrest into an upright position and to provide a resistance force against reclining of the backrest. Such mechanisms typically include a box-shaped control housing mounted beneath the seat in which a coil spring is mounted. Typically, the coil spring must be large in size to provide adequate resistance, requiring the control housing to take up a large amount of space beneath the seat. Also, the adjustment mechanism for varying the tension of the coil spring typically requires a large number of mechanical components contained within the control housing, increasing the difficulty of manufacture of the chair, the overall cost of the chair, and the overall weight of the chair. Further, manual adjustment of existing tension mechanisms is often confusing and tedious for the user, often requiring a user to rotate an adjustment knob over a very large number of turns.

What is needed is a task chair which includes a ride mechanism with a tension assembly which is an improvement over the foregoing.

SUMMARY OF THE INVENTION

The present invention provides a task chair, including a backrest assembly and a seat assembly pivotally coupled both to one another and to side portions of a fixed yoke member for synchronized movement, in which the seat of the seat assembly moves upwardly and forwardly concurrently with recline of the backrest of the backrest assembly. The chair further includes a tension assembly including an elongate tension member, such as a leaf spring, secured at one end thereof to the yoke member, and a contact member, such as a contact roller, adjustably mounted to the seat assembly. The contact member engages the tension member such that the tension member resists recline of the backrest assembly and concurrent movement of the seat assembly from their initial positions, and also provides a restoring force which tends to move the backrest to its initial upright position and the seat to its initial rearward and lowered position. The contact member is adjustable with respect to the tension member in order to vary the effective moment arm acting upon the tension member, thereby varying the pre-load of the tension member and the resistance provided by the tension member.

In one form thereof, the present invention provides a chair, including a pedestal; a yoke member mounted to the pedestal, the yoke member having a pair of upwardly extending side portions; a backrest assembly and a seat assembly; the backrest assembly including a generally U-shaped backrest frame having a pair of end portions, the end portions respectively pivotally coupled to the side portions of the yoke member at first pivots for reclining movement of the backrest assembly, the end portions of the backrest assembly also respectively pivotally coupled to opposite sides of the seat assembly at second pivots; and the seat assembly movably coupled to the yoke member, and movable upon recline of the backrest from a first position to a second position in which the seat assembly is disposed upwardly of the first position.

In another form thereof, the present invention provides a chair, including a seat support structure; a seat assembly movably connected to the seat support structure and movable from a first position to a second position; and a tension assembly, including a tension member having a first end secured to one of the seat support structure and the seat assembly, and a second cantilevered end; and a contact member mounted to the other of the seat support structure and the seat assembly, the contact member engaging the second end of the tension member upon movement of the seat assembly from the first position to the second position, whereby the tension member provides a return force urging the seat assembly to the first position.

In another form thereof, the present invention provides a chair, including a pedestal; a yoke member mounted to the pedestal, the yoke member having a pair of upwardly extending side portions; a backrest assembly and a seat assembly; the backrest assembly including a backrest frame having a pair of end portions respectively pivotally coupled to the side portions of the yoke member at first pivots for reclining movement of the backrest assembly, the end portions of the backrest assembly respectively pivotally coupled to opposite sides of the seat assembly at second pivots; the seat assembly movably coupled to the yoke member and movable upon recline of the backrest from a first position to a second position in which the seat assembly is disposed upwardly of the first position; and a tension assembly, including an elongate tension member secured at an end thereof to one of the yoke member and the seat assembly; and a contact member mounted to the other of the yoke member and the seat assembly, the contact member engaging the tension member upon movement of the seat assembly from the first position to the second position, whereby the tension member provides a return force urging the seat assembly to the first position.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
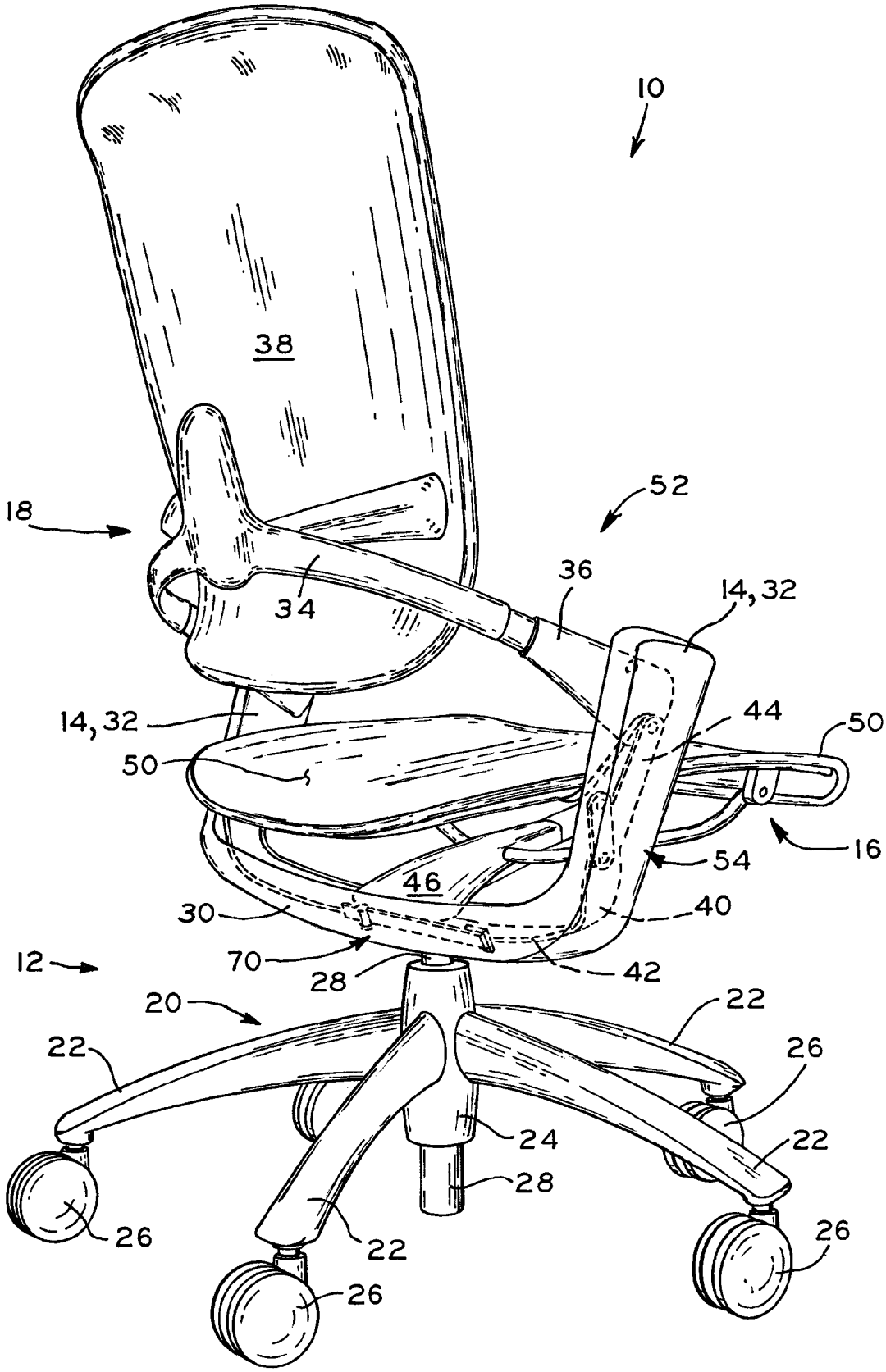
FIG. 1 is a rear perspective view of a task chair including a ride mechanism and tension assembly according to the present invention, with components of one of the linkage assemblies shown in dashed lines.

Referring to FIG. 1, task chair 10 is shown, which generally includes pedestal or base assembly 12, a primary frame or yoke member 14 mounted to base assembly 12, and seat assembly 16 and backrest assembly 18 pivotally mounted to one another and to yoke member 14 for synchronized movement as described below. Base assembly 12 generally includes chair base 20 having a plurality of arms 22 projecting from hub 24, with arms 22 having caster wheels 26 at the ends thereof for rolling movement of chair 10 along a floor surface. Hub 24 of chair base 20 is fitted with a pneumatic cylinder 28 having an upper end thereof secured to yoke member 14 to provide vertical height adjustment of yoke member 14, seat assembly 16, and backrest assembly 18 with respect to base assembly 12 in a manner well known in the art.

Yoke member 14 generally includes transverse beam 30 and a pair of upwardly-extending side portions 32 at opposite ends of transverse beam 30. The upper end of pneumatic cylinder 28 is mounted to transverse beam 30 in a suitable manner, such as by welding or by a press-fit engagement, for example.

Backrest assembly 18 generally includes a substantially U-shaped backrest frame 34 having a pair of end portions 36 pivotally connected to the upper ends of side portions 32 of yoke member 14 and to seat assembly 16 as discussed below. Backrest assembly 18 additionally includes backrest 38 connected to back frame 34 to support the back of a seated user. Backrest 38 may include a flexible elastomeric structural material having one or more rigid members embedded therein, which provide connection points for securing backrest 38 to back frame 34 in a pivotal manner, as discussed in detail in U.S. patent application Ser. No. 10/315,838, entitled CHAIR WITH LUMBAR SUPPORT AND CONFORMING BACK, filed on Dec. 10, 2002, and U.S. patent application Ser. No. 10/887,362, entitled CHAIR WITH LUMBAR SUPPORT AND CONFORMING BACK, filed on Jul. 8, 2004, each assigned to the assignee of the present invention, the disclosures of which are expressly incorporated herein by reference. Backrest 38 may optionally include a cushion (not shown) attached thereto.

Figures 2A, 2B:
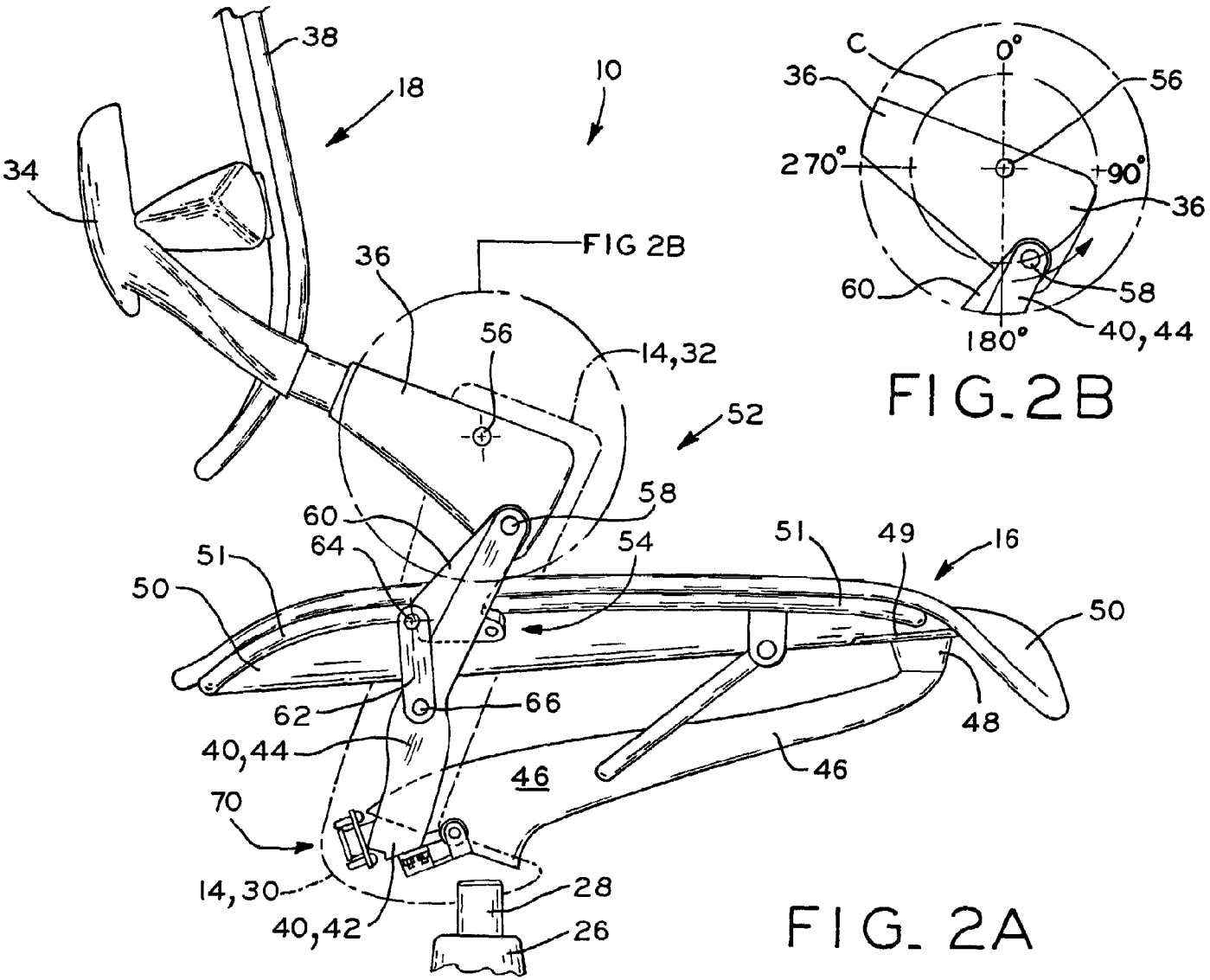
FIG. 2A is a fragmentary right side view of a portion of the chair of FIG. 1 with the right side portion of the yoke member shown in ghost lines, further showing the backrest and seat assemblies in a first position in which the backrest is disposed in an upright position and the seat is disposed in a rearward and lowered position.
FIG. 2B is a schematic view of a portion of FIG. 2A.

Seat assembly 16 generally includes a secondary frame or seat support cradle having transverse beam 42 with a pair of side portions 44 extending therefrom, and front beam 46 extending forwardly from transverse beam 42. Side portions 44 of seat support cradle 40 are pivotally connected to yoke member 14 and to end portions 36 of backrest assembly 18 in the manner discussed below. Front beam 46 of seat support cradle 40 is attached to a central front portion of seat 50 by a resilient bushing 48 secured between front beam 46 and horn 49 of seat 50, as shown in FIGS. 2A and 3, to support the central front portion of seat 50. Seat 50 includes a flexible, elastomeric structural material having a rigid horn 49 embedded within a front central portion of seat 50, and seat 50 also includes a U-shaped support rod 51 embedded therein, which extends along the side edges of seat 50 and around the rear edge of seat 50, similar to the seat constructions which are described in detail in U.S. patent application Ser. No. 10/315,590, entitled CHAIR WITH CONFORMING SEAT, filed on Dec. 10, 2002, assigned to the assignee of the present invention, the disclosure which is expressly incorporated herein by reference. As discussed in detail in the foregoing U.S. patent application Ser. No. 10/315,590, horn 49 and support rod 51 may be insert molded within the material of seat 50, and seat 50 may be resiliently flexible responsive to the weight of a seated user between a first position in which the seat has a generally flat shape, and a second position in which the front side portions of the seat are flexed downwardly about horn 49, bushing 48, and front beam 46 of seat support cradle 42 to form a saddle-like shape to support the thighs of a seated user. Also, seat 50 may optionally include a cushion (not shown) thereon.

Figures 3A, 3B:
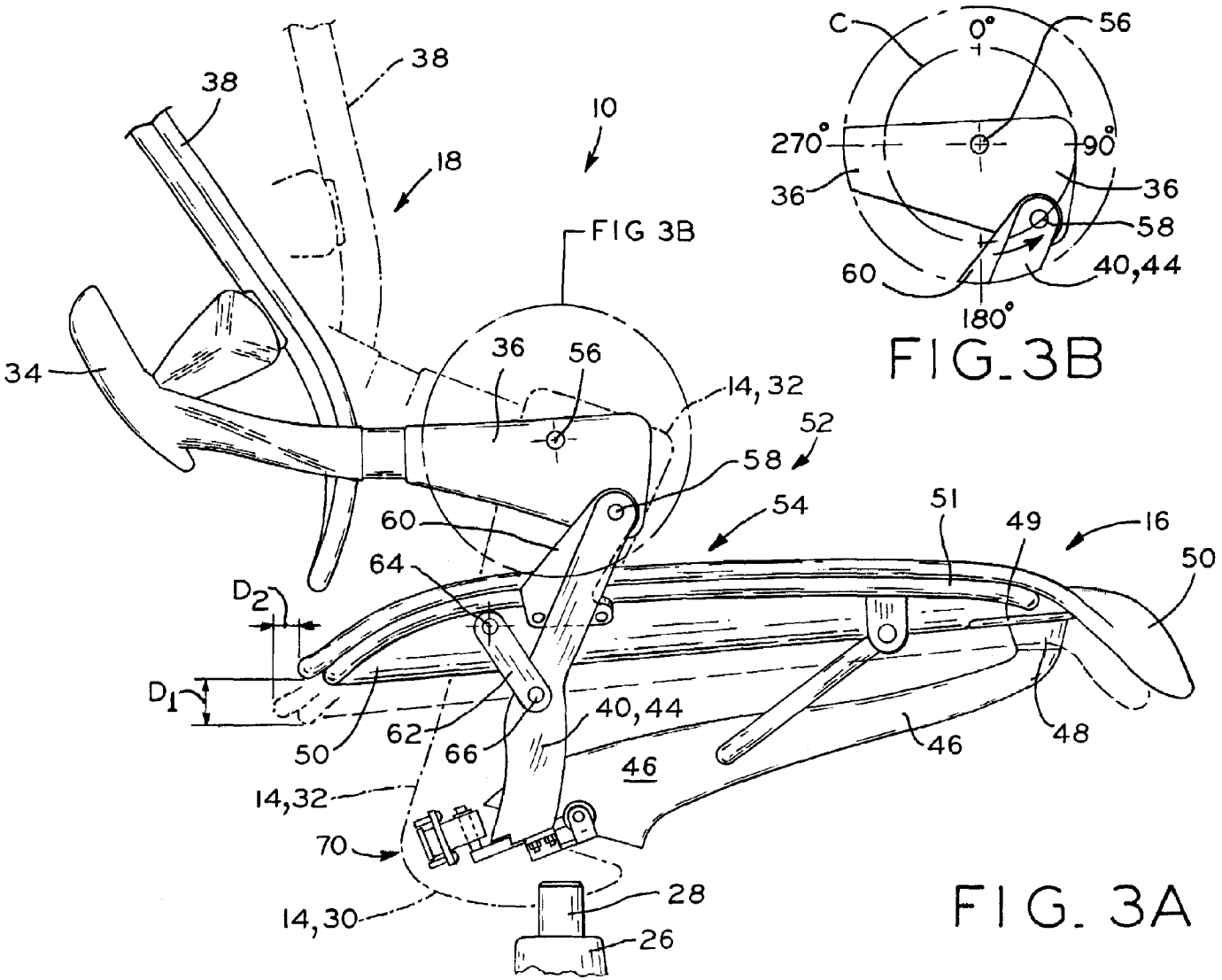
FIG. 3A is a fragmentary right side view of a portion of the chair of FIG. 1 with the right side portion of the yoke member shown in ghost lines, further showing the backrest and seat assemblies in a second position in which the backrest is disposed in a reclined position and the seat is disposed in a forward and raised position.
FIG. 3B is a schematic view of a portion of FIG. 3A.

Referring additionally to FIGS. 2A and 3A, chair 10 additionally includes a ride mechanism 52 including a pair of linkage assemblies 54 for pivotally connecting backrest assembly 18 and seat assembly 16 to each other and to yoke member 14 for synchronized movement of backrest assembly 18 and seat assembly 16 responsive to movement of a seated user, as described below. Each linkage assembly 54 is associated with one side of chair 10, and hereinafter, only the linkage assembly 54 on the right side of chair 10, which is shown in FIGS. 1-3B, will be described below for convenience. However, it should be understood that chair 10 includes two identical such linkage assemblies 54 which are mirror images of one another, one on the right side of chair 10 and associated with the right side portion 32 of yoke member 14, and the other on the left side of chair 10 and associated with the left side portion 32 of yoke member 14, wherein the two linkage assemblies 54 operate in the same manner.

Referring to FIG. 2A, end portion 36 of backrest frame 34 is pivotally connected to the upper end of side portion 32 of yoke member 14 at a first pivot 56, and is pivotally connected to the upper end of side portion 44 of seat support cradle 40 at a second pivot 58 which is spaced below and slightly forwardly of first pivot 56. A generally L-shaped seat support 60 is also connected at second pivot 58 to end portion 36 of backrest 38 and to the upper end of side portion 44 of seat support cradle 40. Seat support 60 generally includes a first or upper end connected at second pivot 58 and a second or lower end connected to seat support rod 51 beneath seat 50 to thereby support the rear right side of seat 50. Link 62 includes an upper end connected to side portion 32 of yoke member 14 at a third pivot 64, and a lower end connected to side portion 44 of seat support cradle 40 at a fourth pivot 66 which is spaced below and slightly forwardly of third pivot 64. Generally, first pivot 56, second pivot 58, third pivot 64, and fourth pivot 66, along with the foregoing structures which are connected by the these pivots, form a "four-bar" type linkage structure which pivotally connects backrest assembly 18 and seat assembly 16 both to one another and to yoke member 14. First, second, third, and fourth pivots 56, 58, 64, and 66 may be formed as pivot pins or bolts, for example, or alternatively, may be formed as hinges.

Second pivot 58 is located in line with the hip joint of a seated user to facilitate comfortable reclining movement of backrest assembly 18 about the user's hip joint, to keep the lumbar area of backrest 38 fully in contact with the lumbar region of the user's back, and to eliminate the "shirt pull" effect observed in many existing chairs which include a backrest which pivots independently of the seat.

Referring to FIG. 2A, backrest assembly 18 and seat assembly 16 are shown in a first position in which backrest assembly 18 is disposed in a relatively upright position, and seat assembly 16 is disposed in a rearward and lowered position. Referring to FIGS. 2A and 3A, when a user seated upon seat assembly 16 leans backwardly against backrest 38 of backrest assembly 18, backrest 38 reclines from its upright position, shown in FIG. 2A, toward a reclined position, shown in FIG. 3A. Concurrently, end portion 36 of backrest frame 34 pivots at first pivot 56, and end portion 36 also pivots with respect to seat support cradle at second pivot 58 to thereby raise seat support cradle 40 and seat 50 from the position shown in FIG. 2A to the position shown in FIG. 3A, with link 62 concurrently pivoting at third pivot 64 and fourth pivot 66 to support the forward and upward movement of seat support cradle 40 with respect to yoke member 14.

Referring to FIG. 2A, it may be seen that in the foregoing first position of backrest and seat assemblies 18 and 16, second pivot 58 is disposed at a substantially five o'clock position with respect to first pivot 56, and moves to a substantially four o'clock position with respect to first pivot 56 in the second position of FIG. 3A. Also, it may be seen from FIGS. 2A and 3A that between the foregoing first and second positions of backrest and seat assemblies 18 and 16, fourth pivot 66 moves from a substantially six o'clock position with respect to third pivot 64 to a substantially five o'clock position with respect to third pivot 64. In this manner, first and third pivots 56 and 64 are stationary pivots with respect to yoke member 14, while second and fourth pivots 58 and 66 are movable with respect to yoke member 14. The foregoing arrangement of pivots facilitates movement of seat assembly 16 generally upwardly and forwardly from the first position shown in FIG. 2A to the second position shown in FIG. 3A, wherein dimension $D_1$ in FIG. 3A denotes the upward component of movement of seat 50 and dimension $D_2$ in FIG. 3A denotes the forward component of movement of seat 50. Advantageously, as a user reclines against backrest assembly 18, seat 50 is moved upwardly and slightly forwardly to aid in supporting the seated user adjacent a desk or other work surface at which a user is seated. Also, the user's horizontal line of sight is not shifted to a great extent as the user reclines in chair 10.

The forgoing movement of second pivot 58 with respect to first pivot 56 is also schematically illustrated in FIGS. 2B and 3B. Referring to FIG. 2B, in the first position of backrest and seat assemblies 18 and 16, first pivot 56 is located at the center of an imaginary circle C, and second pivot 58 is located on circle C between the 180° and 90° positions on circle C with respect to first pivot 56. Referring to FIG. 3B, upon reclining movement of backrest assembly 18 and concurrent upward and forward movement of seat assembly 16, second pivot 58 moves with respect to first pivot 56 along a portion of the circumference of circle C toward the 0° position on circle C. The foregoing relative positions of first and second pivots 56 and 58 on each side of chair 10 are superimposed upon one another, and therefore appear to be the same, when chair 10 is viewed from one side. However, because the two linkage assemblies 52 on opposite sides of chair 10 are mirror image of one another, it will be understood that from the right side of chair 10, second pivot 58 will appear to move counterclockwise in the foregoing manner around circle C while from the left side of chair 10, second pivot 58 will appear to move clockwise around circle C.

Figure 5:
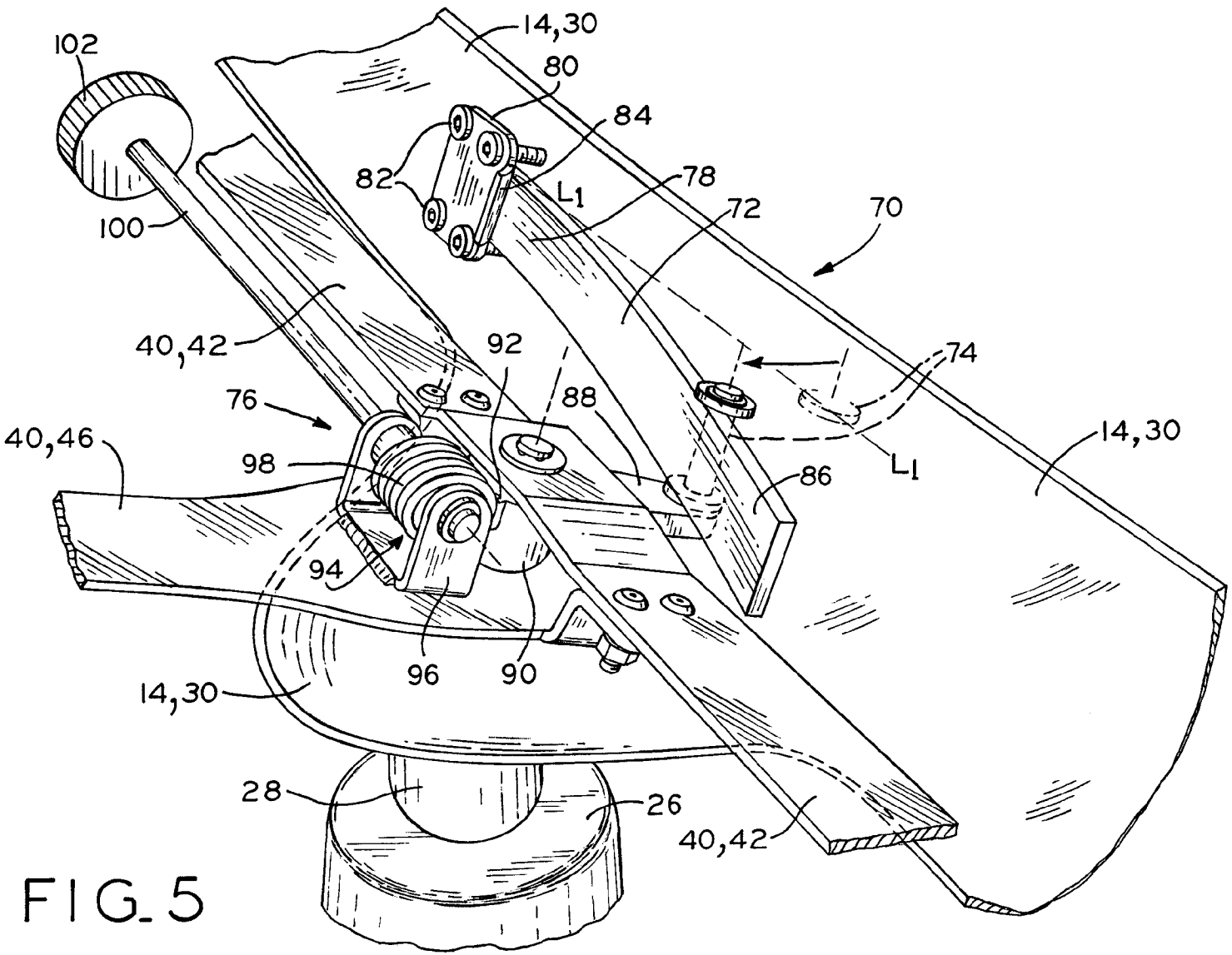
FIG. 5 is a fragmentary perspective view of a portion of the yoke member and seat assembly, showing the components of the tension assembly with the seat assembly disposed in the position of FIG. 3.
Figure 6:
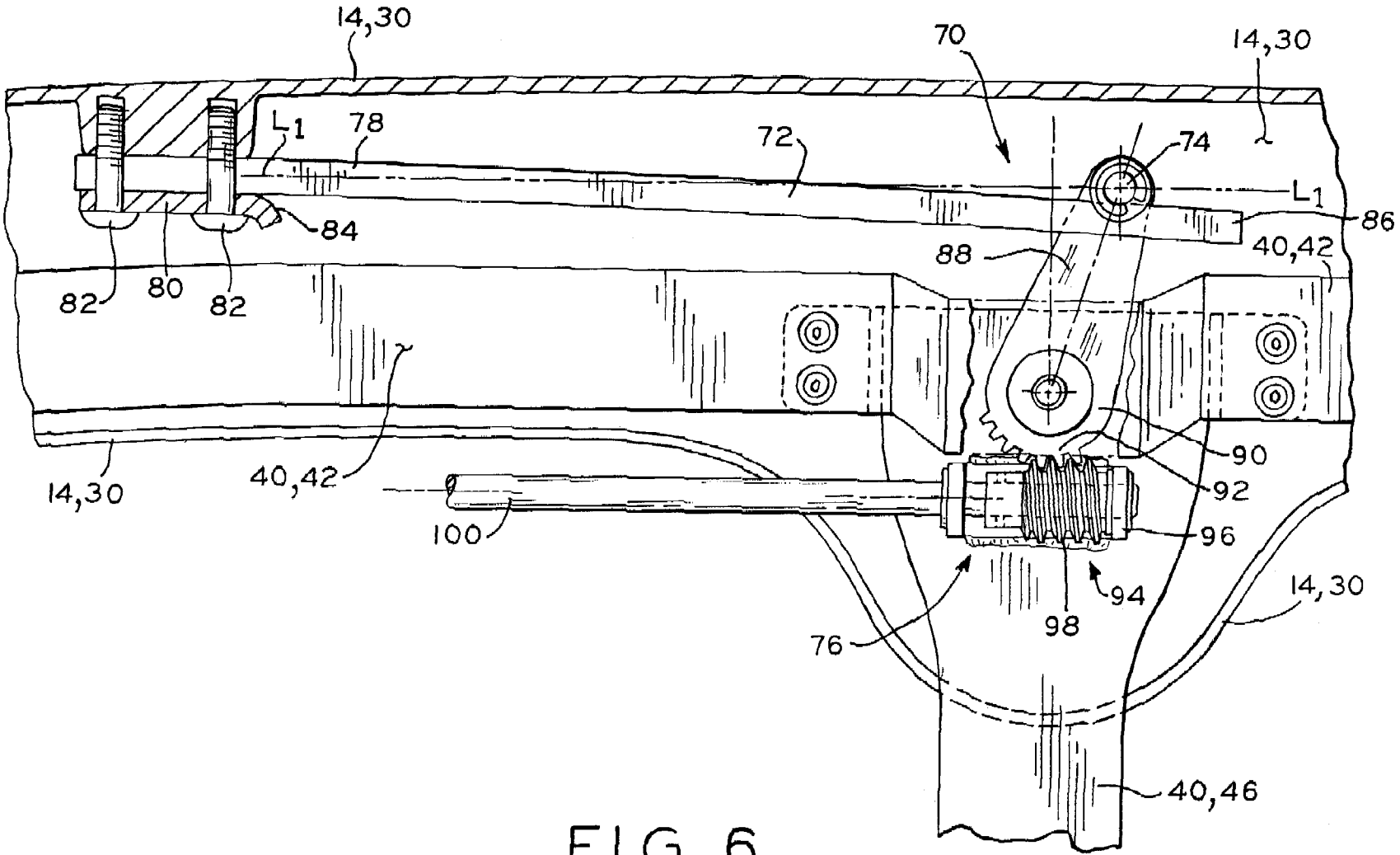
FIG. 6 is a fragmentary perspective view of the tension assembly, shown with the contact member of the tension assembly adjusted to a position wherein the tension member provides a minimum resistance force.
Figure 7:
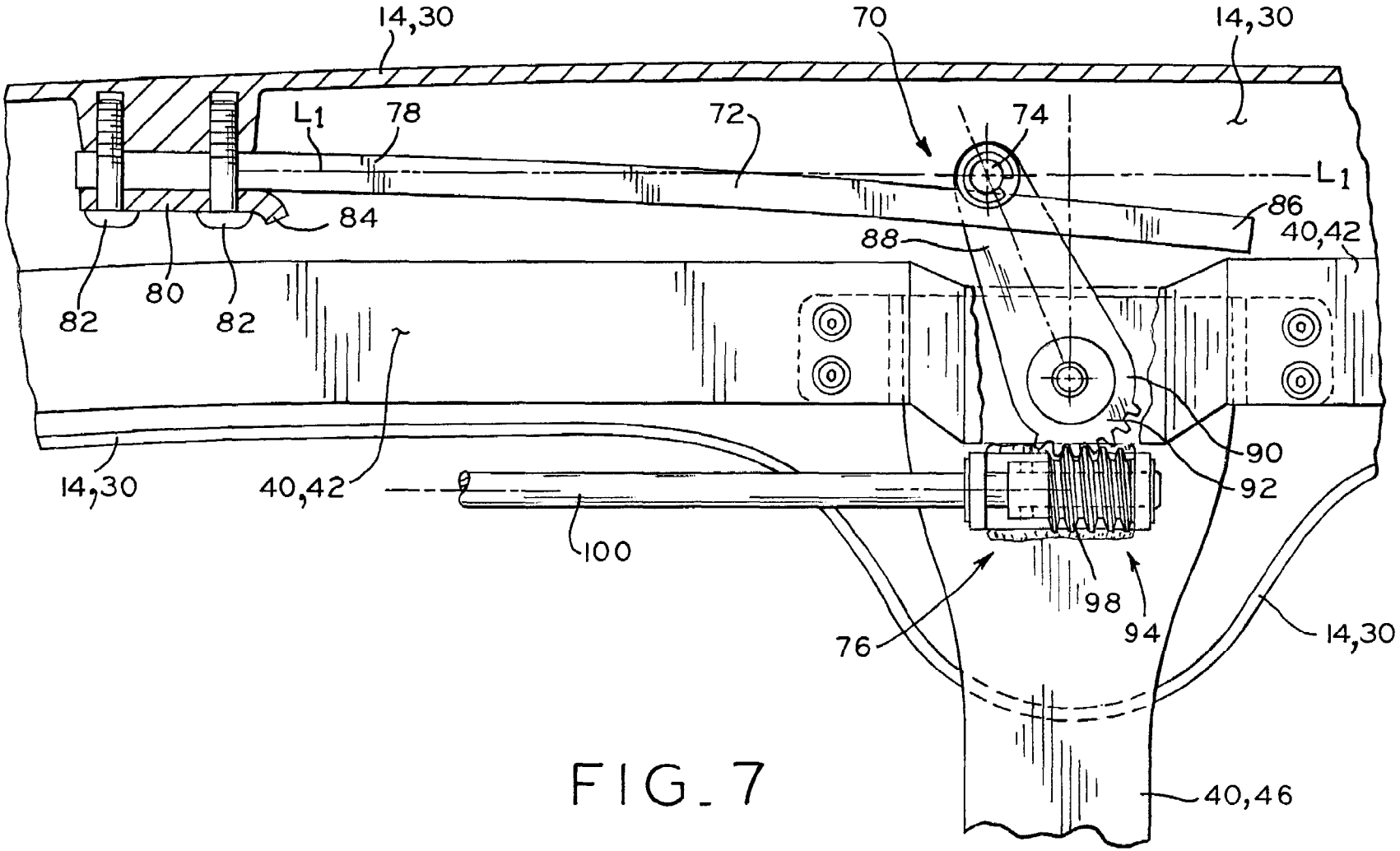
FIG. 7 is a fragmentary perspective view of the tension assembly, shown with the contact member of the tension assembly adjusted to a position wherein the tension member provides a maximum resistance force.

Referring to FIGS. 5-7, chair 10 also includes tension assembly 70 for providing a resistance force which tends to resist movement of backrest assembly 18 and seat assembly 16 from the first position shown in FIG. 2A. Tension assembly 70 generally includes a tension member 72, shown herein as a leaf spring or flexible bar, a contact member, shown herein as a contact roller 74, and an adjustment mechanism 76. Advantageously, as discussed below and shown in FIGS. 5-7, tension assembly 70 includes a relatively few number of parts, particularly moving parts, and does not take up a large amount of space beneath seat assembly 16, thereby obviating the need for a box-type control housing of the type commonly used in existing task chairs.

Tension member 72 is formed as an elongate bar having first end 78 mounted to yoke member 14 by capture plate 80 and a plurality of fasteners 82, with capture plate 80 including upturned lip 84 to support bending movement of tension member 72. Second end 86 of tension member 72 is disposed opposite first end 78 and is cantilevered therefrom. In one form, tension member 72 may be formed of a glass fiber/epoxy composite bar having a 17×6.3 mm cross section. This material is available from Glasforms, Inc. of San Jose, Calif., and has a flexural modulus of $5.5\times10^6$ p.s.i., a flexural strength of $100\times10^3$ p.s.i., and a tensile strength of $100\times10^3$ p.s.i. Tension member 72 includes a longitudinal axis $L_1$-$L_1$. Alternatively, tension member may be a bar of metal such as spring steel, or a bar made of a rigid, yet flexible, plastic material. Tension member 72 is resistant to forces applied generally transverse to longitudinal axis $L_1$-$L_1$ which forces tend to bend tension member 72 away from its longitudinal axis $L_1$-$L_1$.

Adjustment mechanism 76 is attached to transverse beam 42 of seat support cradle 40, and includes adjustment arm 88 pivotally mounted to transverse beam 42. Adjustment arm 88 includes contact roller 74 at a first end thereof, which is in engagement with tension member 72 adjacent second end 86 of tension member 72. The opposite end of adjustment arm 88 includes hub 90 pivotally mounted to transverse beam 42, with hub 90 including a plurality of gear teeth 92 around at least a portion of its outer periphery. Worm gear 94 is rotatably mounted to a clevis 96 of transverse beam 42, and includes worm 98 in meshing engagement with gear teeth 92 of hub 90 of adjustment arm 88. Shaft 100 extends from worm gear 94 and includes adjustment knob 102 mounted to an end thereof for actuation by the seated user.

Figure 4:
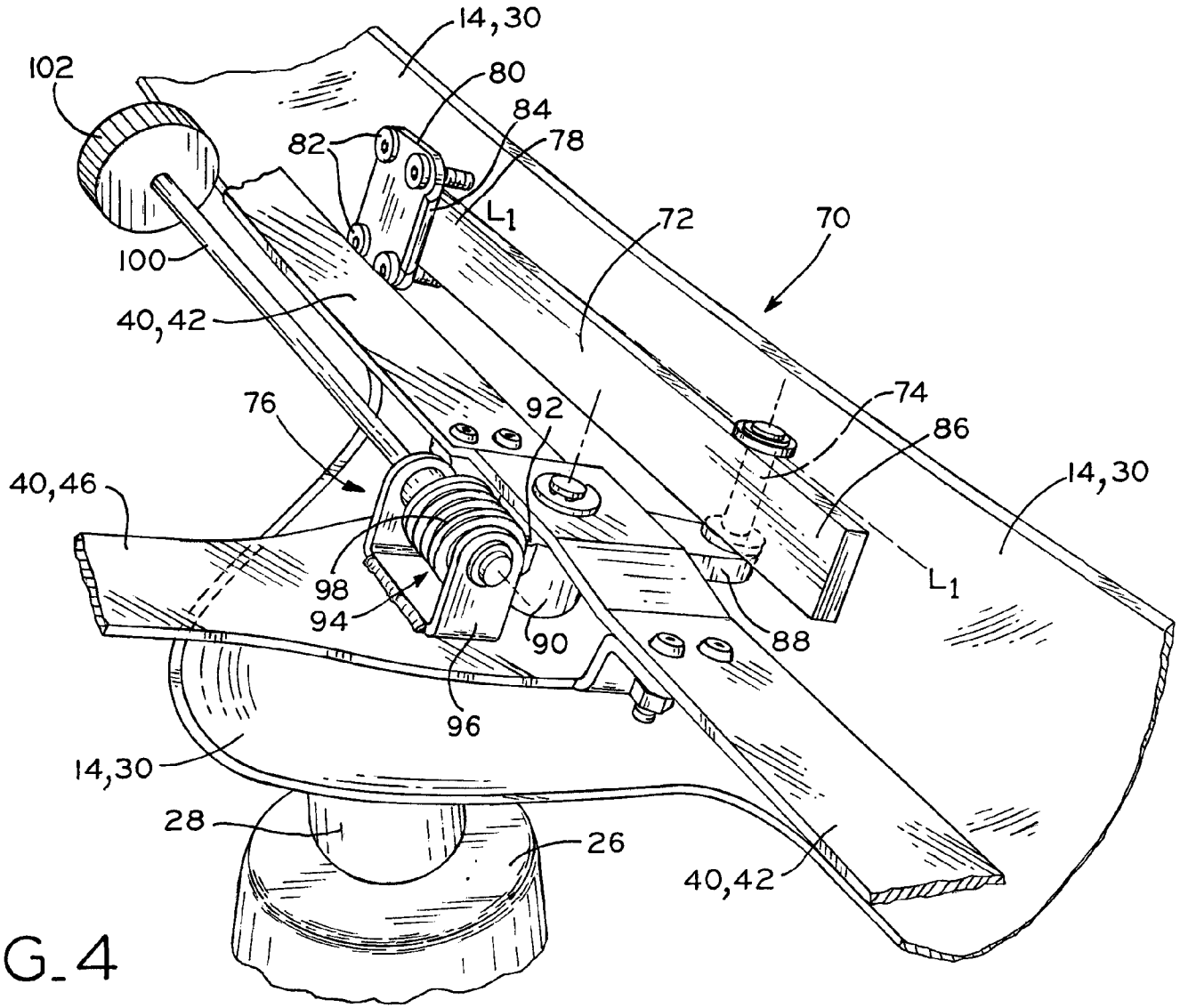
FIG. 4 is a fragmentary perspective view of a portion of the yoke member and seat assembly, showing the components of the tension assembly with the seat assembly disposed in the position of FIG. 2.

Referring to FIGS. 4 and 5, contact roller 74 of adjustment mechanism 76 is disposed in an intermediate tension position, in which adjustment arm 88 is disposed generally transverse to longitudinal axis $L_1$-$L_1$ of tension member 72. In the position of FIG. 4, which corresponds to the initial or first position of seat and backrest assemblies 16 and 18 shown in FIG. 2 and discussed above, contact roller 74 engages tension member 72 to cause tension member 72 to bend slightly away from its longitudinal axis $L_1$-$L_1$. In this manner, tension member 72 exerts a force upon contact roller 74, which in turn provides a constant resistance or "pre-load" force which tends to resist the forward and upward movement of seat assembly 16 with respect to yoke member 14 and the concurrent recline of backrest assembly 18 from their initial positions, as described above. When a seated user reclines against backrest assembly 18 to recline backrest assembly 16 and concurrently move seat assembly 16 upwardly and forwardly, contact roller 74 moves upwardly and forwardly along with seat cradle 44 of seat assembly 16 to thereby bend tension member 72 further away from its longitudinal axis $L_1$-$L_1$ as shown in FIG. 5. In this manner, tension member 72 provides both a resistance to recline of backrest assembly 18 and the upward and forward movement of seat assembly 16, as well as a restoring force which tends to return backrest assembly 18 and seat assembly 16 to their first position, shown in FIG. 2, when the seated user removes force from backrest assembly 18.

Adjustment mechanism 76 of tension assembly 70 is adjustable to vary the location of engagement between contact roller 74 and tension member 72 along the length of tension member 72, and to in turn vary both the "pre-load" force and the resistance force provided by tension member 72 to the movement of backrest assembly 18 and seat assembly 16 from the first position shown in FIG. 2. Specifically, rotation of knob 102 by a seated user rotates shaft 100 and worm gear 94, with worm 98 engaging teeth 92 of hub 90 of adjustment arm 88 to pivot adjustment arm 88 and vary the location of contact between contact roller 74 and tension member 72. In FIG. 6, adjustment mechanism 76 is shown adjusted to a minimum resistance position in which adjustment arm 88 is angularly disposed with respect to the longitudinal axis $L_1$-$L_1$ of tension member 72, and contact roller 74 has been moved toward second end 86 of tension member 72 from the intermediate tension position shown in FIG. 4. In this manner, the effective moment arm acting upon tension member 72 is increased, such that upon recline of backrest assembly 18 and concurrent movement of seat assembly 16 from the first position of FIG. 2, tension member 72 is more easily bent and provides less resistance force toward movement of backrest assembly 18 and seat assembly 16 from the position shown in FIG. 2 to the position shown in FIG. 3.

In FIG. 7, adjustment mechanism 76 has been adjusted to a maximum resistance position in which adjustment arm 88 is angularly disposed with respect to the longitudinal axis $L_1$-$L_1$ of tension member 72, and contact roller 74 has been moved toward first end 78 of tension member 72 from the intermediate tension position shown in FIG. 4. In this manner, the effective moment arm acting upon tension member 72 is decreased, such that upon recline of backrest assembly 18 and concurrent movement of seat assembly 16 from the first position of FIG. 2A, tension member 72 is less easily bent and provides a greater resistance force toward movement of backrest assembly 18 and seat assembly 16 from the position shown in FIG. 2A to the position shown in FIG. 3A.

Further, contact roller 74 may be adjustably positioned in any position between those shown in FIGS. 4-7 to provide varying levels of resistance. In this manner, the position of engagement between contact roller 74 and tension member 72 is selectively adjustable by the user to vary the effective moment arm acting upon tension member 72 and in turn the resistant force applied by tension member 72 to the recline of backrest assembly 18 and concurrent movement of seat assembly upwardly and forwardly. The geared engagement between worm 98 of worm gear 94 and teeth 92 of hub 90 of adjustment arm 88 allows adjustment arm 88 to be moved between its full range of movement, shown in FIGS. 6 and 7, with a minimal number of turns of adjustment knob 102 and shaft 100 by a user to thereby allow quick and easy adjustment of tension assembly 70 in the manner described above by the user.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A chair, comprising:

a pedestal including a plurality of arms having wheels at respective ends thereof;

a pneumatic cylinder mounted to said pedestal;

a yoke member connected to said pneumatic cylinder, said yoke member having a pair of upwardly extending side portions;

a backrest assembly and a seat assembly;

said backrest assembly including a generally U-shaped backrest frame having a pair of end portions, said end portions respectively pivotally coupled to said side portions of said yoke member at first pivots for reclining movement of said backrest assembly, said end portions of said backrest assembly also respectively pivotally coupled to opposite sides of said seat assembly at second pivots; and said seat assembly movably coupled to said yoke member, and movable upon recline of said backrest assembly from a first position to a second position in which said seat assembly is disposed upwardly of said first position.

2. The chair of claim 1, wherein said second pivots are disposed forwardly with respect to said first pivots when said seat assembly is in said first position.

3. The chair of claim 1, wherein said second pivots are disposed downwardly with respect to said first pivots when said seat assembly is in said first position.

4. The chair of claim 1 wherein, as viewed from one side of said chair, said first pivots are each disposed at the center of a circle and said second pivots are respectively disposed on said circles between a 180° position and a 90° position with respect to said first pivots, and wherein upon recline of said backrest assembly, said second pivots move along a portion of the circumferences of said circles toward a 0° position with respect to said first pivots.

5. The chair of claim 1, wherein said chair further includes a tension assembly, comprising:

an elongate tension member secured at an end thereof to one of said yoke member and said seat assembly; and a contact member mounted to the other of said yoke member and said seat assembly, said contact member engaging said tension member upon movement of said seat assembly from said first position to said second position, whereby said tension member provides a return force urging said seat assembly to said first position.

6. The chair of claim 5, wherein said contact member is adjustably mounted to the other of said yoke member and said seat assembly to vary the location of engagement between said contact member and said tension member.

7. The chair of claim 5, wherein said tension member is an elongate leaf spring having a longitudinal axis, said leaf spring resistant to bending forces transverse to said longitudinal axis.

8. A chair, comprising:

a pedestal;

a pneumatic cylinder mounted to said pedestal;

a yoke member connected to said pneumatic cylinder, said yoke member having a pair of upwardly extending side portions;

a backrest assembly and a seat assembly;

said backrest assembly including a backrest frame having a pair of end portions, said end portions respectively pivotally coupled to said side portions of said yoke member at first pivots for reclining movement of said backrest assembly, said end portions of said backrest assembly also respectively pivotally coupled to opposite sides of said seat assembly at second pivots; and said seat assembly movably coupled to said yoke member, and movable upon recline of said backrest from a first position to a second position in which said seat assembly is disposed upwardly and forwardly of said first position.

9. The chair of claim 8, wherein said second pivots are disposed forwardly with respect to said first pivots when said seat assembly is in said first position.

10. The chair of claim 8, wherein said second pivots are disposed downwardly with respect to said first pivots when said seat assembly is in said first position.

11. The chair of claim 8 wherein, as viewed from one side of said chair, said first pivots are each disposed at the center of a circle and said second pivots are respectively disposed on said circles between a 180° position and a 90° position with respect to said first pivots, and wherein upon recline of said backrest, said second pivots move along a portion of the circumferences of said circles toward a 0° position with respect to said first pivots.

12. The chair of claim 8, wherein said seat assembly comprises:

a seat support cradle pivotally coupled to said backrest assembly at said second pivots and pivotally coupled to said yoke member at a least one third pivot; and a seat supported by said seat support cradle.

* * * * *